US011006740B2

(12) United States Patent
Best

(10) Patent No.: US 11,006,740 B2
(45) Date of Patent: May 18, 2021

(54) PRESSURIZED PAINT BRUSH ASSEMBLY

(71) Applicant: Kasey Best, Ellijay, GA (US)

(72) Inventor: Kasey Best, Ellijay, GA (US)

( * ) Notice: Subject to any disclaimer, the term of this patent is extended or adjusted under 35 U.S.C. 154(b) by 0 days.

(21) Appl. No.: 16/433,514

(22) Filed: Jun. 6, 2019

(65) Prior Publication Data

US 2020/0383465 A1 Dec. 10, 2020

(51) Int. Cl.

| | |
|---|---|
| ***A46B 11/06*** | (2006.01) |
| ***A46B 5/00*** | (2006.01) |
| ***B05B 1/12*** | (2006.01) |
| ***B05B 1/30*** | (2006.01) |
| ***B05B 15/65*** | (2018.01) |

(52) U.S. Cl.

CPC ..... *A46B 11/063* (2013.01); *A46B 5/00* (2013.01); *B05B 1/12* (2013.01); *B05B 1/30* (2013.01); *B05B 15/65* (2018.02); *A46B 11/06* (2013.01); *A46B 2200/202* (2013.01)

(58) Field of Classification Search

CPC ... A46B 11/063; A46B 11/1106; A46B 11/00; A46B 5/00; A46B 5/002; A46B 5/0033; A46B 5/0041; A46B 2200/202; A46B 2200/20; B05B 1/12; B05B 1/30; B05B 15/65

USPC ..... 401/268, 270, 275, 278, 282, 284, 285, 401/286, 289

See application file for complete search history.

(56) References Cited

U.S. PATENT DOCUMENTS

| | | | | | |
|---|---|---|---|---|---|
| 626,750 | A | | 6/1899 | Carter | |
| 1,342,211 | A | * | 6/1920 | Hainsey | A46B 11/063 401/278 |
| 2,553,681 | A | | 5/1951 | Renne | |
| 2,959,801 | A | | 11/1960 | Pelham | |
| 3,603,694 | A | * | 9/1971 | Hamm | B05C 17/002 401/150 |
| 3,676,010 | A | | 7/1972 | Kirch | |
| 3,915,382 | A | * | 10/1975 | Davis | B05B 15/628 239/195 |
| 4,167,349 | A | | 9/1979 | Testa | |
| 4,790,679 | A | | 12/1988 | Murphy | |
| 4,983,954 | A | | 1/1991 | Huston | |
| 5,071,278 | A | | 12/1991 | Chen | |
| 5,595,451 | A | * | 1/1997 | Harrison, Jr. | B05B 1/00 401/219 |
| 5,904,434 | A | | 5/1999 | Bekius | |
| 9,155,379 | B2 | | 10/2015 | Castellana | |

* cited by examiner

*Primary Examiner* — David J Walczak

(57) ABSTRACT

A pressurized paint brush assembly for attaching a paint brush to a paint sprayer includes a spray nozzle that is fluidly coupled to supply hose of a paint sprayer for receiving pressurized fluid paint from the paint sprayer. A hose is fluidly and removably coupled to the spray nozzle and the hose receives the pressurized fluid paint from the spray nozzle. A paint brush is included that has a fluid input and a plurality of bristles that is each in fluid communication with the fluid input. The fluid input is fluidly coupled to the hose such that the each of the bristles receives the pressurized fluid paint. In this way the paint brush can be attached to the paint sprayer to paint a surface.

5 Claims, 6 Drawing Sheets

PRESSURIZED PAINT BRUSH ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to paint brush devices and more particularly pertains to a new paint brush device for attaching a paint brush to a paint sprayer.

BRIEF SUMMARY OF THE INVENTION

An embodiment of the disclosure meets the needs presented above by generally comprising a spray nozzle that is fluidly coupled to supply hose of a paint sprayer for receiving pressurized fluid paint from the paint sprayer. A hose is fluidly and removably coupled to the spray nozzle and the hose receives the pressurized fluid paint from the spray nozzle. A paint brush is included that has a fluid input and a plurality of bristles that is each in fluid communication with the fluid input. The fluid input is fluidly coupled to the hose such that the each of the bristles receives the pressurized fluid paint. In this way the paint brush can be attached to the paint sprayer to paint a surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
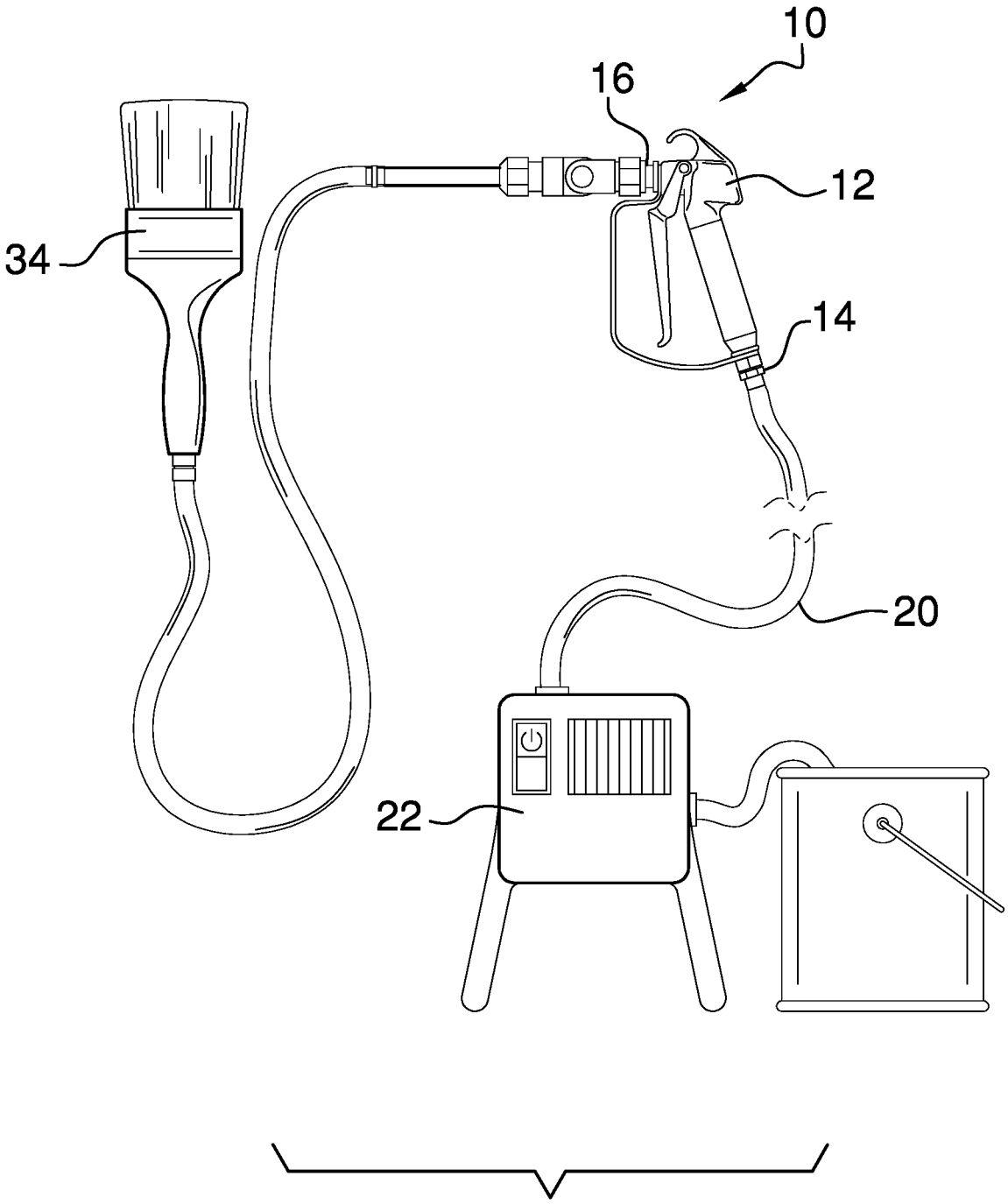
FIG. 1 is a perspective view of a pressurized paint brush assembly according to an embodiment of the disclosure.
Figure 2:
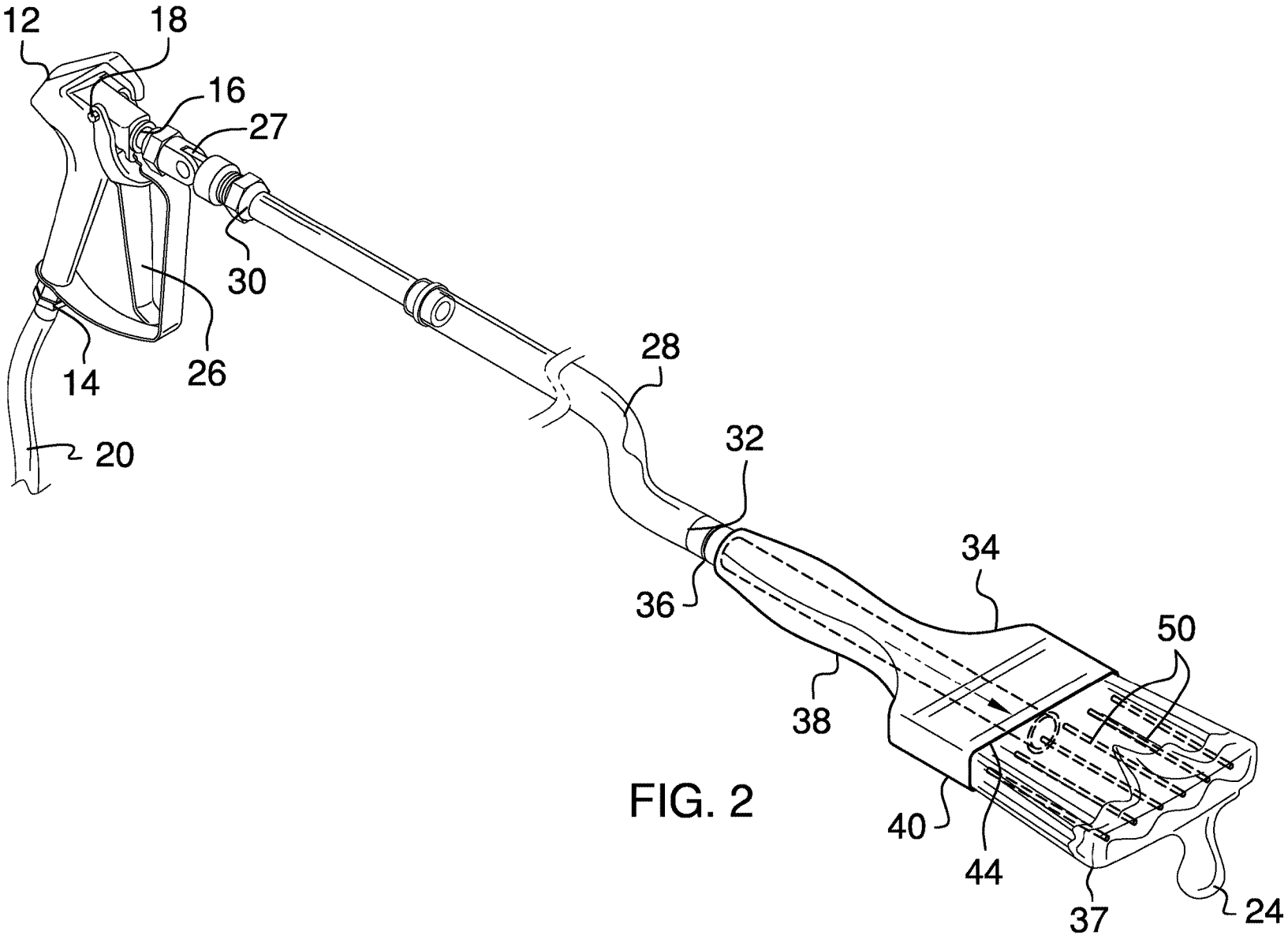
FIG. 2 is a phantom perspective view of an embodiment of the disclosure.
Figure 3:
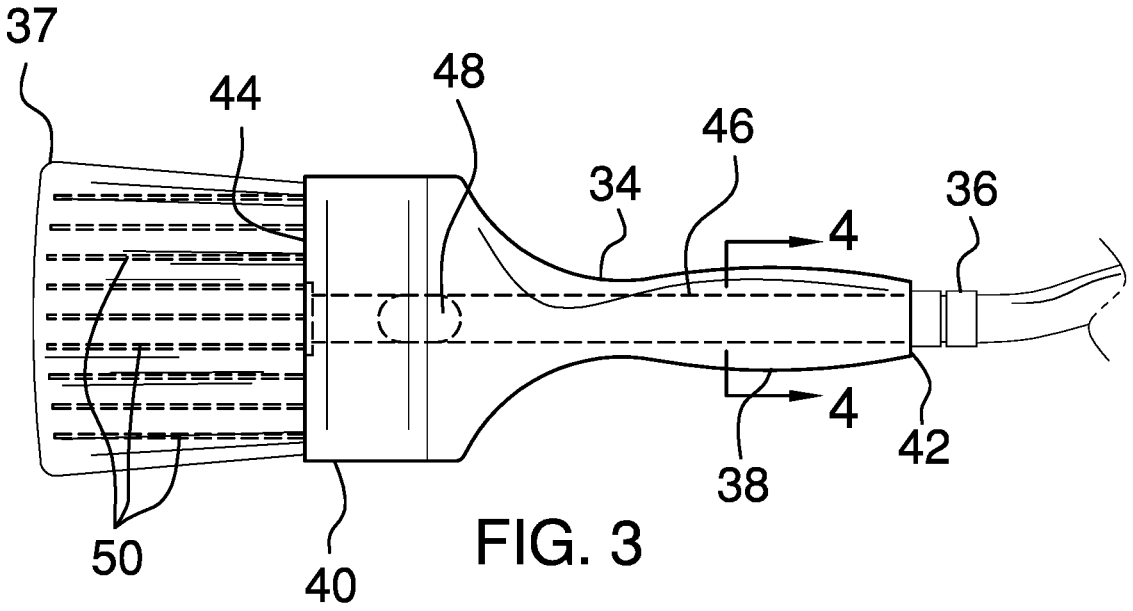
FIG. 3 is a top phantom view of a paint brush of an embodiment of the disclosure.
Figure 4:
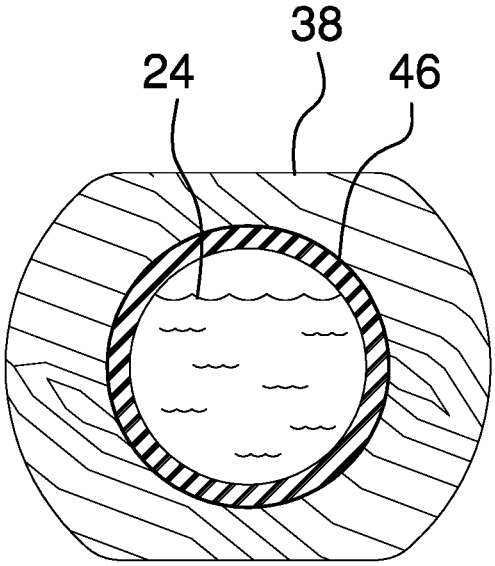
FIG. 4 is a cross sectional view taken along line 4-4 of FIG. 3 of an embodiment of the disclosure.
Figure 5:
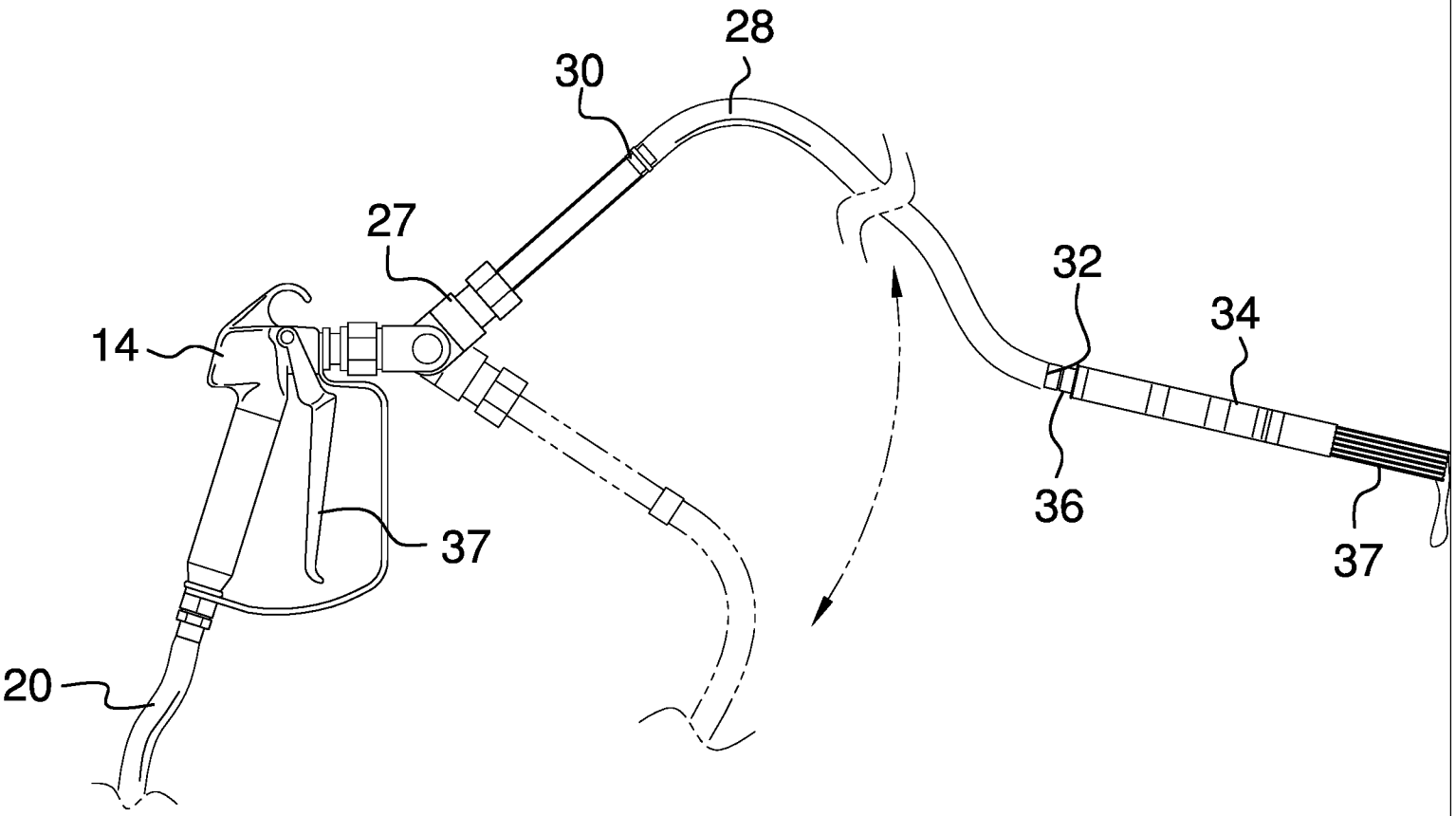
FIG. 5 is a perspective in-use view of an embodiment of the disclosure.

With reference now to the drawings, and in particular to FIGS. 1 through 7 thereof, a new paint brush device embodying the principles and concepts of an embodiment of the disclosure and generally designated by the reference numeral 10 will be described.

As best illustrated in FIGS. 1 through 7, the pressurized paint brush assembly 10 generally comprises a spray nozzle 12 that has an input 14, an output 16 and a valve 18 that is fluidly coupled between the input 14 and the output 16. The input 14 is fluidly coupled to supply hose 20 of a paint sprayer 22. In this way the spray nozzle 12 can receive pressurized fluid paint 24 from the paint sprayer 22. The paint sprayer 22 may be a powered paint sprayer 22 of any conventional design, including consumer and commercial sprayers. The pressurized fluid paint 24 may be any interior or exterior paint commonly applied with paint sprayers.

The valve 18 is positionable between an open position to release the pressurized fluid paint 24 and a closed position to restrict the pressurized fluid paint 24. The spray nozzle 12 has a trigger 26 that is pivotally coupled thereto and the trigger 26 is coupled to the valve 18. The valve 18 is biased into the closed position and the valve 18 is urged into the open position when the trigger 26 is manipulated. The spray nozzle 12 may be a paint spraying nozzle such as is commonly employed with compressed air sprayers or the like. Additionally, the valve 18 may be a fluid valve 18 capable of metering the delivery of pressurized fluid paint 24. A pivot 27 is pivotally coupled to the output 16 and the pivot 27 is pivotable upwardly and downwardly on the output 16. Additionally, the pivot 27 comprises a jointed conduit or the like that is capable of passing the pressurized fluid paint 24 therethrough.

A hose 28 is fluidly and removably coupled to the pivot 16 and the hose 28 receives the pressurized fluid paint 24 when the valve 18 is opened. The hose 28 has a first end 30 and a second end 32, and the first end 30 is in fluid communication with the output 16 of the spray nozzle 12. A paint brush 34 is provided that has a fluid input 36 and a plurality of bristles 37. Each of the bristles 37 is in fluid communication with the fluid input 36 and the fluid input 36 is fluidly coupled to the hose 28. Thus, each of the bristles 37 can receive the pressurized fluid paint 24 when the valve 18 is opened. In this way the pressurized fluid paint 24 is delivered to the paint brush 34 to paint a surface.

The paint brush 34 has a handle 38 and a stock 40, the handle 38 has a distal end 42 with respect to the stock 40 and the stock 40 has a distal surface 44 with respect to the handle 38. The paint brush 34 has a conduit 46 extending through the distal end 42 of the handle 38 and the distal surface 44 of the stock 40. The fluid input 36 is positioned on the distal end 42 of the handle 38 and is in fluid communication with the conduit 46. Additionally, each of the bristles 37 is positioned on the distal surface 44 of the stock 40.

A pressure reducer 48 is provided and the pressure reducer 48 is positioned within the conduit 46. The pressure reducer 48 reduces a flow rate of the conduit 46 by a pre-determined percentage. In this way the pressure reducer 48 lowers the pressure of the pressurized fluid paint 24. Thus, the pressurized fluid paint 24 is delivered at a rate that is sufficiently slow for applying with a paint brush 34.

Figure 6:
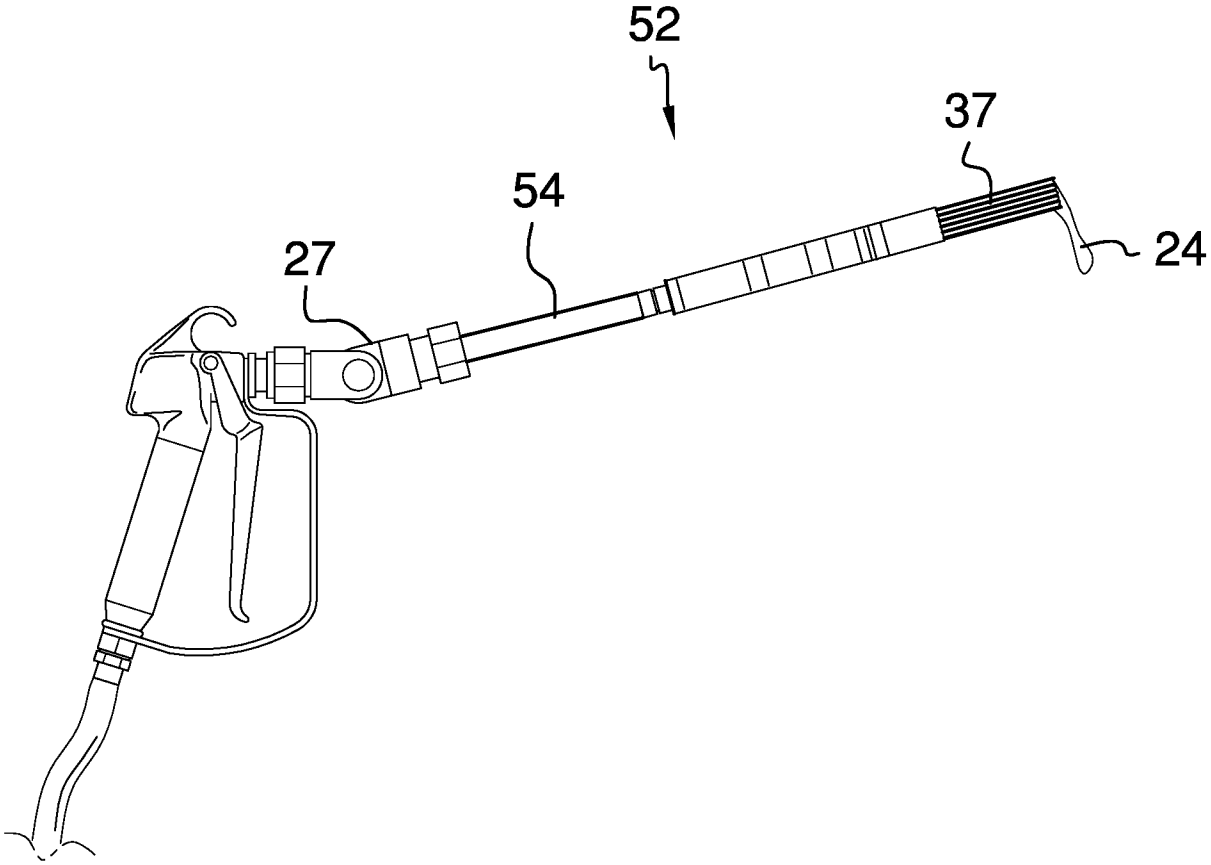
FIG. 6 is a perspective view of an alternative embodiment of the disclosure.
Figure 7:
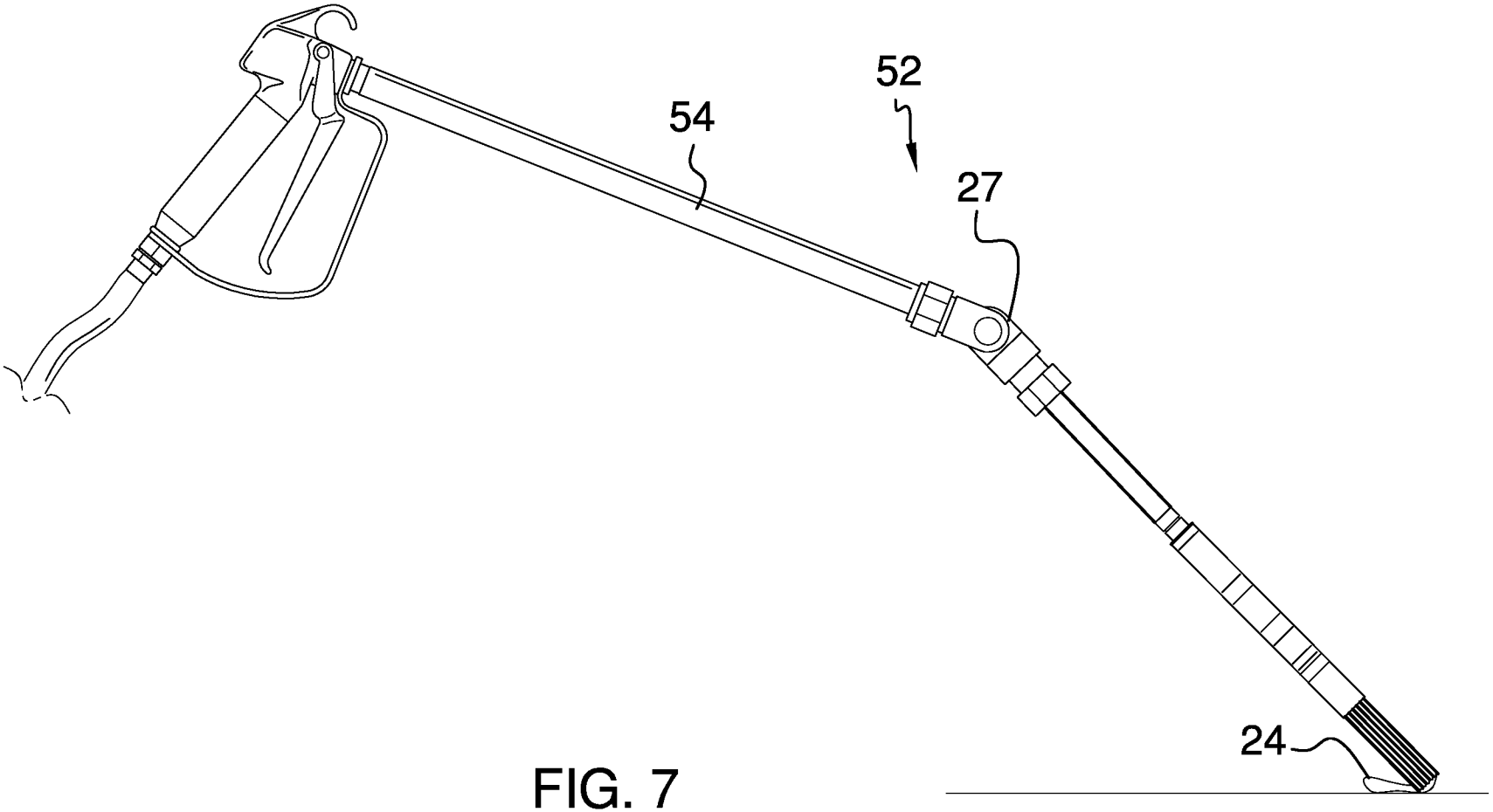
FIG. 7 is a perspective in-use view of an alternative embodiment of the disclosure.

A plurality of tubes 50 is each coupled to the paint brush 34 and the tubes are distributed amongst the bristles 37. Each of the tubes 50 is in fluid communication with the fluid input 36 to receive the pressurized fluid paint 24 thereby facilitating the pressurized fluid paint 24 to be applied to the surface. Each of the tubes 50 is coupled to the distal surface 44 of the stock 40 and is in fluid communication with the conduit 46 on the distal surface 44. Moreover, each of the tubes 50 is comprised of a flexible material such that the tubes 50 do not interfere with the normal motion of the bristles 37 during painting. Each of the tubes 50 has a diameter that is no greater that the diameter of the bristles 37 on the paint brush. In an alternative embodiment 52 as shown in FIGS. 6 and 7, a pipe 54 may be fluidly coupled between the spray nozzle 12 and the paint brush 34.

In use, a spray head, or other accessory, is uncoupled from the supply hose 20 of the paint sprayer 22 and the spray nozzle 12 is fluidly coupled to the supply hose 20. Thus, the paint brush 34 can be employed to paint instead of the spray head. The trigger 26 is squeezed to open the valve 18 and thusly deliver the pressurized fluid paint 24 to the paint brush 34. Thus, the paint brush 34 is supplied with a continuous flow of paint while the trigger 26 is squeezed. The valve 18 closes when the trigger 26 is released thereby stopping the flow of paint to the paint brush 34. Thus, existing paint sprayers 22 can be used to apply paint by spraying and by brushing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pressurized paint brush assembly being configured to deliver a fluid paint under pressure to a paint brush, said assembly comprising:

a spray nozzle having an input, an output and a valve being fluidly coupled between said input and said output, said input being fluidly coupled to supply hose of a paint sprayer wherein said spray nozzle is configured to receive pressurized fluid paint from the paint sprayer, said valve being positionable between an open position wherein said valve is configured to release the pressurized fluid paint and a closed position wherein said valve is configured to restrict the pressurized fluid paint, said spray nozzle having a trigger being pivotally coupled thereto, said trigger being coupled to said valve, said valve being biased into said closed position, said valve being urged into said open position when said trigger is manipulated;

a hose being fluidly and removably coupled to said output wherein said hose is configured to receive the pressurized fluid paint when said valve is opened, said hose having a first end and a second end, said first end being fluidly coupled to said output of said spray nozzle; and a paint brush having a fluid input and a plurality of bristles each being in fluid communication with said fluid input, said fluid input being fluidly coupled to said second end of said hose wherein said paint brush is configured to be manipulated separately from said spray nozzle and each of said bristles is configured to receive the pressurized fluid paint when said valve is opened thereby facilitating said paint brush to paint a surface.

2. The assembly according to claim 1, wherein said paint brush has a handle and a stock, said handle having a distal end with respect to said stock, said stock having a distal surface with respect to said handle, said paint brush having a conduit extending through said distal end of said handle and said distal surface of said stock, said fluid input being positioned on said distal end of said handle and being in fluid communication with said conduit, each of said bristles being positioned on said distal surface of said stock.

3. The assembly according to claim 2, further comprising a pressure reducer being positioned within said conduit, said pressure reducer reducing a flow rate of said conduit by a pre-determined percentage wherein said pressure reducer is configured to lower the pressure of the pressurized fluid paint.

4. The assembly according to claim 3, further comprising a plurality of tubes, each of said tubes being coupled to said paint brush and being distributed amongst said bristles, each of said tubes being in fluid communication with said fluid input wherein each of said tubes is configured to receive the pressurized fluid paint thereby facilitating the pressurized fluid paint to be applied to the surface, each of said tubes being coupled to said distal surface of said stock and being in fluid communication with said conduit, each of said tubes being comprised of a flexible material.

5. A pressurized paint brush assembly being configured to deliver a fluid paint under pressure to a paint brush, said assembly comprising:

a spray nozzle having an input, an output and a valve being fluidly coupled between said input and said output, said input being fluidly coupled to supply hose of a paint sprayer wherein said spray nozzle is configured to receive pressurized fluid paint from the paint sprayer, said valve being positionable between an open position wherein said valve is configured to release the pressurized fluid paint and a closed position wherein said valve is configured to restrict the pressurized fluid paint, said spray nozzle having a trigger being pivotally coupled thereto, said trigger being coupled to said valve, said valve being biased into said closed position, said valve being urged into said open position when said trigger is manipulated;

a hose being fluidly and removably coupled to said output wherein said hose is configured to receive the pressurized fluid paint when said valve is opened, said hose having a first end and a second end, said first end being fluidly coupled to said output of said spray nozzle;

a paint brush having a fluid input and a plurality of bristles each being in fluid communication with said fluid input, said fluid input being fluidly coupled to said second end of said hose wherein said paint brush is configured to be manipulated separately from said spray nozzle and each of said bristles is configured to receive the pressurized fluid paint when said valve is opened thereby facilitating said paint brush to paint a surface, said paint brush having a handle and a stock, said handle having a distal end with respect to said stock, said stock having a distal surface with respect to said handle, said paint brush having a conduit extending through said distal end of said handle and said distal surface of said stock, said fluid input being positioned on said distal end of said handle and being in fluid communication with said conduit, each of said bristles being positioned on said distal surface of said stock;

a pressure reducer being positioned within said conduit, said pressure reducer reducing a flow rate of said conduit by a pre-determined percentage wherein said pressure reducer is configured to lower the pressure of the pressurized fluid paint;

a plurality of tubes, each of said tubes being coupled to said paint brush and being distributed amongst said bristles, each of said tubes being in fluid communication with said fluid input wherein each of said tubes is configured to receive the pressurized fluid paint thereby facilitating the pressurized fluid paint to be applied to the surface, each of said tubes being coupled to said distal surface of said stock and being in fluid communication with said conduit, each of said tubes being comprised of a flexible material.

* * * * *